US007011096B2

(12) United States Patent
Li et al.

(10) Patent No.: US 7,011,096 B2
(45) **Date of Patent: *Mar. 14, 2006**

(54) OXIDANT/CATALYST NANOPARTICLES TO REDUCE CARBON MONOXIDE IN THE MAINSTREAM SMOKE OF A CIGARETTE

(75) Inventors: Ping Li, Chesterfield, VA (US); Mohammad Hajaligol, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/942,881

(22) Filed: Aug. 31, 2001

(65) Prior Publication Data

US 2003/0075193 A1 Apr. 24, 2003

(51) Int. Cl.
*A24B 15/18* (2006.01)

(52) U.S. Cl. ..... 131/334; 131/364

(58) Field of Classification Search ..... 131/349, 131/347, 360, 364; 502/300, 302, 303, 304, 502/308, 313, 316
See application file for complete search history.

(56) References Cited

U.S. PATENT DOCUMENTS

| | | | | |
|---|---|---|---|---|
| 3,472,237 | A * | 10/1969 | Stephens | 131/121 |
| 3,720,214 | A | 3/1973 | Norman et al. | |
| 3,796,793 | A * | 3/1974 | Metzer et al. | 423/263 |
| 3,807,416 | A | 4/1974 | Hedge et al. | |
| 3,931,824 | A | 1/1976 | Miano et al. | |
| 4,109,663 | A | 8/1978 | Maeda et al. | |
| 4,119,104 | A | 10/1978 | Roth | |
| 4,193,412 | A | 3/1980 | Heim et al. | |
| 4,195,645 | A | 4/1980 | Bradley, Jr. et al. | |
| 4,197,861 | A | 4/1980 | Keith | |
| 4,317,460 | A | 3/1982 | Dale et al. | |
| 4,397,321 | A * | 8/1983 | Stuetz | 131/334 |
| 4,574,821 | A * | 3/1986 | Fischer et al. | 131/365 |
| 4,956,330 | A | 9/1990 | Elliott et al. | |
| 5,050,621 | A | 9/1991 | Creighton et al. | |
| 5,101,839 | A | 4/1992 | Jakob et al. | |
| 5,105,836 | A | 4/1992 | Gentry et al. | |
| 5,129,408 | A | 7/1992 | Jakob et al. | |
| 5,258,330 | A | 11/1993 | Khandros et al. | |
| 5,258,340 | A * | 11/1993 | Augustine et al. | 502/60 |
| 5,322,075 | A | 6/1994 | Deevi et al. | |
| 5,443,560 | A * | 8/1995 | Deevi et al. | 131/359 |
| 5,446,003 | A * | 8/1995 | Augustine et al. | 502/159 |
| 5,591,368 | A | 1/1997 | Fleischhauer et al. | |
| 5,598,868 | A | 2/1997 | Jakob et al. | |
| 5,934,289 | A | 8/1999 | Watkins et al. | |
| 6,053,176 | A | 4/2000 | Adams et al. | |
| 6,095,152 | A | 8/2000 | Beven et al. | |

FOREIGN PATENT DOCUMENTS

| | | |
|---|---|---|
| CH | 609217 | 2/1979 |
| EP | 0031700 | 7/1981 |
| GB | 685822 | 1/1953 |
| GB | 863287 | 3/1961 |
| GB | 973854 | 10/1964 |
| GB | 1104993 | 3/1968 |
| GB | 1315374 | 5/1973 |
| WO | 87/06104 | 10/1987 |
| WO | 00/40104 | 7/2000 |

OTHER PUBLICATIONS

James E. Brady et al, "Fundamentals of Chemistry, 2nd Edition", John Wiley & Sons, 1981, pp. 409-411.*
Notification of Transmittal of the International Search Report dated Oct. 29, 2002 for PCT/US02/27407.
International Search Report for PCT/US03/34879 dated Feb. 19, 2004.
Written Opinion for PCT/US02/27407 dated Sep. 3, 2003.
Notification of Transmittal of International Preliminary Examination Report for PCT/US02/27407 dated Aug. 2, 2004.
Written Opinion for PCT/US03/34879 dated Aug. 9, 2004.
International Preliminary Examination Report for PCT/US03/34879 dated Feb. 17, 2005.

* cited by examiner

*Primary Examiner*—Dionne A. Walls
(74) *Attorney, Agent, or Firm*—Buchanan Ingersoll PC

(57) ABSTRACT

Cut filler compositions, cigarettes, methods for making cigarettes and methods for smoking cigarettes are provided, which involve the use of nanoparticle additives capable of acting as an oxidant for the conversion of carbon monoxide to carbon dioxide and/or as a catalyst for the conversion of carbon monoxide to carbon dioxide. Cut filler compositions are described which comprise tobacco and at least one nanoparticle additive. Cigarettes are provided, which comprise a tobacco rod, containing a cut filler having at least one nanoparticle additive. Methods for making a cigarette are provided, which involve (i) adding a nanoparticle additive to a cut filler; (ii) providing the cut filler comprising the additive to a cigarette making machine to form a tobacco rod; and (iii) placing a paper wrapper around the tobacco rod to form the cigarette. Further, methods of smoking the cigarette described above are described, which involve lighting the cigarette to form smoke and inhaling the smoke, wherein during the smoking of the cigarette, the additive acts as an oxidant for the conversion of carbon monoxide to carbon dioxide and/or as a catalyst for the conversion of carbon monoxide to carbon dioxide.

29 Claims, 16 Drawing Sheets

$Fe_2O_3 + CO \longrightarrow CO_2 + 2FeO$ $\Delta H$: *8.5 KJ/mol at 23 °C*

*-9.0 KJ/mol at 800 °C*

OXIDANT/CATALYST NANOPARTICLES TO REDUCE CARBON MONOXIDE IN THE MAINSTREAM SMOKE OF A CIGARETTE

FIELD OF INVENTION

The invention relates generally to methods for reducing the amount of carbon monoxide in the mainstream smoke of a cigarette during smoking. More specifically, the invention relates to cut filler compositions, cigarettes, methods for making cigarettes and methods for smoking cigarettes, which involve the use of nanoparticle additives capable of acting as an oxidant for the conversion of carbon monoxide to carbon dioxide and/or as a catalyst for the conversion of carbon monoxide to carbon dioxide.

BACKGROUND

Various methods for reducing the amount of carbon monoxide in the mainstream smoke of a cigarette during smoking have been proposed. For example, British Patent No. 863,287 describes methods for treating tobacco prior to the manufacture of tobacco articles, such that incomplete combustion products are removed or modified during smoking of the tobacco article. This is said to be accomplished by adding a calcium oxide or a calcium oxide precursor to the tobacco. Iron oxide is also mentioned as an additive to the tobacco.

Cigarettes comprising absorbents, generally in a filter tip, have been suggested for physically absorbing some of the carbon monoxide, but such methods are usually not completely efficient. A cigarette filter for removing unwanted byproducts formed during smoking is described in U.S. Reissue Pat. No. RE 31,700, where the cigarette filter comprises dry and active green algae, optionally with an inorganic porous adsorbent such as iron oxide. Other filtering materials and filters for removing unwanted gaseous byproducts, such as hydrogen cyanide and hydrogen sulfide, are described in British Patent No. 973,854. These filtering materials and filters contain absorbent granules of a gas-adsorbent material, impregnated with finely divided oxides of both iron and zinc. In another example, an additive for smoking tobacco products and their filter elements, which comprises an intimate mixture of at least two highly dispersed metal oxides or metal oxyhydrates, is described in U.S. Pat. No. 4,193,412. Such an additive is said to have a synergistically increased absorption capacity for toxic substances in the tobacco smoke. British Patent No. 685,822 describes a filtering agent that is said to oxidize carbon monoxide in tobacco smoke to carbonic acid gas. This filtering agent contains, for example, manganese dioxide and cupric oxide, and slaked lime. The addition of ferric oxide in small amounts is said to improve the efficiency of the product.

The addition of an oxidizing reagent or catalyst to the filter has been described as a strategy for reducing the concentration of carbon monoxide reaching the smoker. The disadvantages of such an approach, using a conventional catalyst, include the large quantities of oxidant that often need to be incorporated into the filter to achieve considerable reduction of carbon monoxide. Moreover, if the ineffectiveness of the heterogeneous reaction is taken into account, the amount of the oxidant required would be even larger. For example, U.S. Pat. No. 4,317,460 describes supported catalysts for use in smoking product filters for the low temperature oxidation of carbon monoxide to carbon dioxide. Such catalysts include mixtures of tin or tin compounds, for example, with other catalytic materials, on a microporous support. Another filter for smoking articles is described in Swiss patent 609,217, where the filter contains tetrapyrrole pigment containing a complexed iron (e.g. haemoglobin or chlorocruorin), and optionally a metal or a metal salt or oxide capable of fixing carbon monoxide or converting it to carbon dioxide. In another example, British Patent No. 1,104,993 relates to a tobacco smoke filter made from sorbent granules and thermoplastic resin. While activated carbon is the preferred material for the sorbent granules, it is said that metal oxides, such as iron oxide, may be used instead of, or in addition to the activated carbon. However, such catalysts suffer drawbacks because under normal conditions for smoking, catalysts are rapidly deactivated, for example, by various byproducts formed during smoking and/or by the heat. In addition, as a result of such localized catalytic activity, such filters often heat up during smoking to unacceptable temperatures.

Catalysts for the conversion of carbon monoxide to carbon dioxide are described, for example, in U.S. Pat. Nos. 4,956,330 and 5,258,330. A catalyst composition for the oxidation reaction of carbon monoxide and oxygen to carbon dioxide is described, for example, in U.S. Pat. No. 4,956,330. In addition, U.S. Pat. No. 5,050,621 describes a smoking article having a catalytic unit containing material for the oxidation of carbon monoxide to carbon dioxide. The catalyst material may be copper oxide and/or manganese dioxide. The method of making the catalyst is described in British Patent No. 1,315,374. Finally, U.S. Pat. No. 5,258,340 describes a mixed transition metal oxide catalyst for the oxidation of carbon monoxide to carbon dioxide. This catalyst is said to be useful for incorporation into smoking articles.

Metal oxides, such as iron oxide have also been incorporated into cigarettes for various purposes. For example, in WO 87/06104, the addition of small quantities of zinc oxide or ferric oxide to tobacco is described, for the purposes of reducing or eliminating the production of certain unwanted byproducts, such as nitrogen-carbon compounds, as well as removing the stale "after taste" associated with cigarettes. The iron oxide is provided in particulate form, such that under combustion conditions, the ferric oxide or zinc oxide present in minute quantities in particulate form is reduced to iron. The iron is claimed to dissociate water vapor into hydrogen and oxygen, and cause the preferential combustion of nitrogen with hydrogen, rather than with oxygen and carbon, thereby preferentially forming ammonia rather than the unwanted nitrogen-carbon compounds.

In another example, U.S. Pat. No. 3,807,416 describes a smoking material comprising reconstituted tobacco and zinc oxide powder. Further, U.S. Pat. No. 3,720,214 relates to a smoking article composition comprising tobacco and a catalytic agent consisting essentially of finely divided zinc oxide. This composition is described as causing a decrease in the amount of polycyclic aromatic compounds during smoking. Another approach to reducing the concentration of carbon monoxide is described in WO 00/40104, which describes combining tobacco with loess and optionally iron oxide compounds as additives. The oxide compounds of the constituents in loess, as well as the iron oxide additives are said to reduce the concentration of carbon monoxide.

Moreover, iron oxide has also been proposed for incorporation into tobacco articles, for a variety of other purposes. For example, iron oxide has been described as particulate inorganic filler (e.g. U.S. Pat. Nos. 4,197,861; 4,195,645; and 3,931,824), as a coloring agent (e.g. U.S. Pat. No. 4,119,104) and in powder form as a burn regulator (e.g.

U.S. Pat. No. 4,109,663). In addition, several patents describe treating filler materials with powdered iron oxide to improve taste, color and/or appearance (e.g. U.S. Pat. Nos. 6,095,152; 5,598,868; 5,129,408; 5,105,836 and 5,101,839). However, the prior attempts to make cigarettes incorporating metal oxides, such as FeO or $Fe_2O_3$ have not led to the effective reduction of carbon monoxide in mainstream smoke.

Despite the developments to date, there remains a need for improved and more efficient methods and compositions for reducing the amount of carbon monoxide in the mainstream smoke of a cigarette during smoking. Preferably, such methods and compositions should not involve expensive or time consuming manufacturing and/or processing steps. More preferably, it should be possible to catalyze or oxidize carbon monoxide not only in the filter region of the cigarette, but also along the entire length of the cigarette during smoking.

SUMMARY

The invention provides cut filler compositions, cigarettes, methods for making cigarettes and methods for smoking cigarettes which involve the use of nanoparticle additives capable of acting as an oxidant for the conversion of carbon monoxide to carbon dioxide and/or as a catalyst for the conversion of carbon monoxide to carbon dioxide.

One embodiment of the invention relates to a cut filler composition comprising tobacco and at least one additive capable of acting as an oxidant for the conversion of carbon monoxide to carbon dioxide and/or as a catalyst for the conversion of carbon monoxide to carbon dioxide, where the additive is in the form of nanoparticles.

Another embodiment of the invention relates to a cigarette comprising a tobacco rod, wherein the tobacco rod comprises cut filler having at least one additive capable of acting as an oxidant for the conversion of carbon monoxide to carbon dioxide and/or as a catalyst for the conversion of carbon monoxide to carbon dioxide, wherein the additive is in the form of nanoparticles.

A further embodiment of the invention relates to a method of making a cigarette, comprising (i) adding an additive to a cut filler, wherein the additive is capable of acting as an oxidant for the conversion of carbon monoxide to carbon dioxide and/or as a catalyst for the conversion of carbon monoxide to carbon dioxide, wherein the additive is in the form of nanoparticles; (ii) providing the cut filler comprising the additive to a cigarette making machine to form a tobacco rod; and (iii) placing a paper wrapper around the tobacco rod to form the cigarette.

Yet another embodiment of the invention relates to a method of smoking the cigarette described above, which involves lighting the cigarette to form smoke and inhaling the smoke, wherein during the smoking of the cigarette, the additive acts as an oxidant for the conversion of carbon monoxide to carbon dioxide and/or as a catalyst for the conversion of carbon monoxide to carbon dioxide.

In a preferred embodiment of the invention, the additive is capable of acting as both an oxidant for the conversion of carbon monoxide to carbon dioxide and as a catalyst for the conversion of carbon monoxide to carbon dioxide. The additive is preferably a metal oxide, such as $Fe_2O_3$, CuO, $TiO_2$, $CeO_2$, $Ce_2O_3$, or $Al_2O_3$, or a doped metal oxide such as $Y_2O_3$ doped with zirconium or $Mn_2O_3$ doped with palladium. Mixtures of additives may also be used. Preferably, the additive is present in an amount effective to convert at least 50% of the carbon monoxide to carbon dioxide. The additive has an average particle size preferably less than about 500 nm, more preferably less than about 100 nm, even more preferably less than about 50 nm, and most preferably less than about 5 nm. Preferably, the additive has a surface area from about 20 $m^2/g$ to about 400 $m^2/g$, or more preferably from about 200 $m^2/g$ to about 300 $m^2/g$.

The cigarettes produced according to the invention preferably have about 5 mg nanoparticle additive per cigarette to about 100 mg additive per cigarette, and more preferably from about 40 mg additive per cigarette to about 50 mg additive per cigarette.

BRIEF DESCRIPTION OF THE DRAWINGS

The above and other objects and advantages of this invention will be apparent upon consideration of the following detailed description, taken in conjunction with the accompanying drawings, in which.

DETAILED DESCRIPTION

Figure 1:
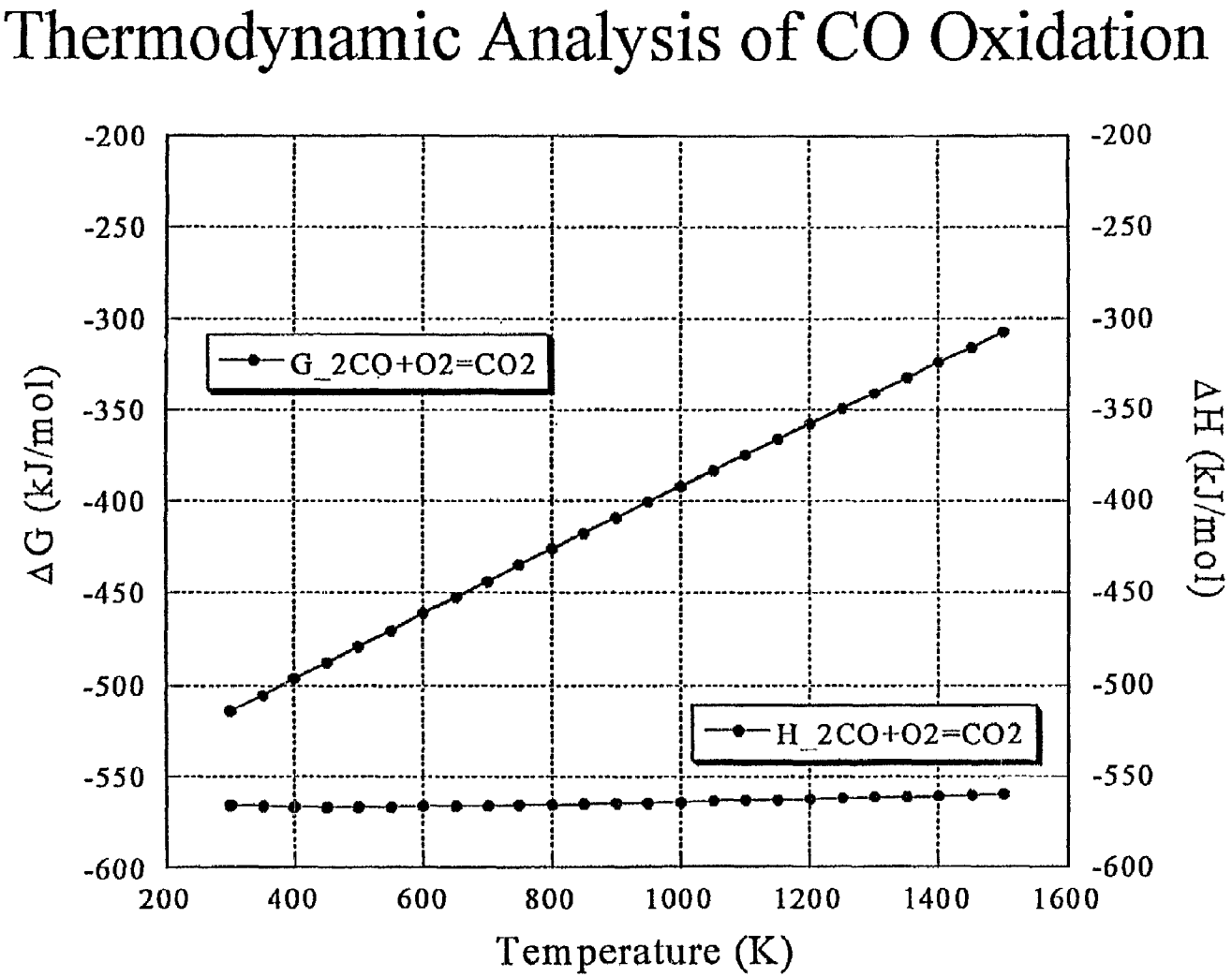
FIG. 1 depicts the temperature dependence of the Gibbs Free Energy and Enthalpy for the oxidation reaction of carbon monoxide to carbon dioxide.

The invention provides cut filler compositions, cigarettes, methods for making cigarettes and methods for smoking cigarettes which involve the use of nanoparticle additives capable of acting as an oxidant for the conversion of carbon monoxide to carbon dioxide and/or as a catalyst for the conversion of carbon monoxide to carbon dioxide. Through the invention, the amount of carbon monoxide in mainstream smoke can be reduced, thereby also reducing the amount of carbon monoxide reaching the smoker and/or given off as second-hand smoke.

The term "mainstream" smoke refers to the mixture of gases passing down the tobacco rod and issuing through the filter end, i.e. the amount of smoke issuing or drawn from the mouth end of a cigarette during smoking of the cigarette. The mainstream smoke contains smoke that is drawn in through both the lighted region, as well as through the cigarette paper wrapper.

The total amount of carbon monoxide formed during smoking comes from a combination of three main sources: thermal decomposition (about 30%), combustion (about 36%) and reduction of carbon dioxide with carbonized tobacco (at least 23%). Formation of carbon monoxide from thermal decomposition starts at a temperature of about 180° C., and finishes at around 1050° C., and is largely controlled by chemical kinetics. Formation of carbon monoxide and carbon dioxide during combustion is controlled largely by the diffusion of oxygen to the surface ($k_a$) and the surface reaction ($k_b$). At 250° C., $k_a$ and $k_b$, are about the same. At 400° C., the reaction becomes diffusion controlled. Finally, the reduction of carbon dioxide with carbonized tobacco or charcoal occurs at temperatures around 390° C. and above. Besides the tobacco constituents, the temperature and the oxygen concentration are the two most significant factors affecting the formation and reaction of carbon monoxide and carbon dioxide.

While not wishing to be bound by theory, it is believed that the nanoparticle additives can target the various reactions that occur in different regions of the cigarette during smoking. During smoking there are three distinct regions in a cigarette: the combustion zone, the pyrolysis/distillation zone, and the condensation/filtration zone. First, the "combustion region" is the burning zone of the cigarette produced during smoking of the cigarette, usually at the lighted end of a cigarette. The temperature in the combustion zone ranges from about 700° C. to about 950° C., and the heating rate can go as high as 500° C./second. The concentration of oxygen is low in this region, since it is being consumed in the combustion of tobacco to produce carbon monoxide, carbon dioxide, water vapor, and various organics. This reaction is highly exothermic and the heat generated here is carried by gas to the pyrolysis/distillation zone. The low oxygen concentrations coupled with the high temperature leads to the reduction of carbon dioxide to carbon monoxide by the carbonized tobacco. In this region, the nanoparticle additive acts as an oxidant to convert carbon monoxide to carbon dioxide. As an oxidant, the nanoparticle additive oxidizes carbon monoxide in the absence of oxygen. The oxidation reaction begins at around 150° C., and reaches maximum activity at temperatures higher than about 460° C.

The "pyrolysis region" is the region behind the combustion region, where the temperatures range from about 200° C. to about 600° C. This is where most of the carbon monoxide is produced. The major reaction in this region is the pyrolysis (i.e. the thermal degradation) of the tobacco that produces carbon monoxide, carbon dioxide, smoke components, and charcoal using the heat generated in the combustion zone. There is some oxygen present in this zone, and thus the nanoparticle additive may act as a catalyst for the oxidation of carbon monoxide to carbon dioxide. As a catalyst, the nanoparticle additive catalyzes the oxidation of carbon monoxide by oxygen to produce carbon dioxide. The catalytic reaction begins at 150° C. and reaches maximum activity around 300° C. The nanoparticle additive preferably retains its oxidant capability after it has been used as a catalyst, so that it can also function as an oxidant in the combustion region as well.

Third, there is the condensation/filtration zone, where the temperature ranges from ambient to about 150° C. The major process is the condensation/filtration of the smoke components. Some amount of carbon monoxide and carbon dioxide diffuse out of the cigarette and some oxygen diffuses into the cigarette. However, in general, the oxygen level does not recover to the atmospheric level.

As mentioned above, the nanoparticle additives may function as an oxidant and/or as a catalyst, depending upon the reaction conditions. In a preferred embodiment of the invention, the additive is capable of acting as both an oxidant for the conversion of carbon monoxide to carbon dioxide and as a catalyst for the conversion of carbon monoxide to carbon dioxide. In such an embodiment, the catalyst will provide the greatest effect. It is also possible to use combinations of additives to obtain this effect.

By "nanoparticles" is meant that the particles have an average particle size of less than a micron. The additive preferably has an average particle size less than about 500 nm, more preferably less than about 100 nm, even more preferably less than about 50 nm, and most preferably less than about 5 nm. Preferably, the additive has a surface area from about 20 $m^2/g$ to about 400 $m^2/g$, or more preferably from about 200 $m^2/g$ to about 300 $m^2/g$.

The nanoparticles may be made using any suitable technique, or the nanoparticles can be purchased from a commercial supplier. For instance, MACH I, Inc., King of Prussia, Pa. sells $Fe_2O_3$ nanoparticles under the trade names NANOCAT® Superfine Iron Oxide (SFIO) and NANOCAT® Magnetic Iron Oxide. The NANOCAT® Superfine Iron Oxide (SFIO) is amorphous ferric oxide in the form of a free flowing powder, with a particle size of about 3 nm, a specific surface area of about 250 $m^2/g$, and a bulk density of about 0.05 g/mL. The NANOCAT® Superfine Iron Oxide (SFIO) is synthesized by a vapor-phase process, which renders it free of impurities that may be present in conventional catalysts, and is suitable for use in food, drugs, and cosmetics. The NANOCAT® Magnetic Iron Oxide is a free flowing powder with a particle size of about 25 nm and a surface area of about 40 $m^2/g$.

Preferably, the selection of an appropriate nanoparticle catalyst and/or oxidant will take into account such factors as stability and preservation of activity during storage conditions, low cost and abundance of supply. Preferably, the nanoparticle additive will be a benign material. Further, it is preferred that the nanoparticles do not react or form unwanted byproducts during smoking.

Figure 2:
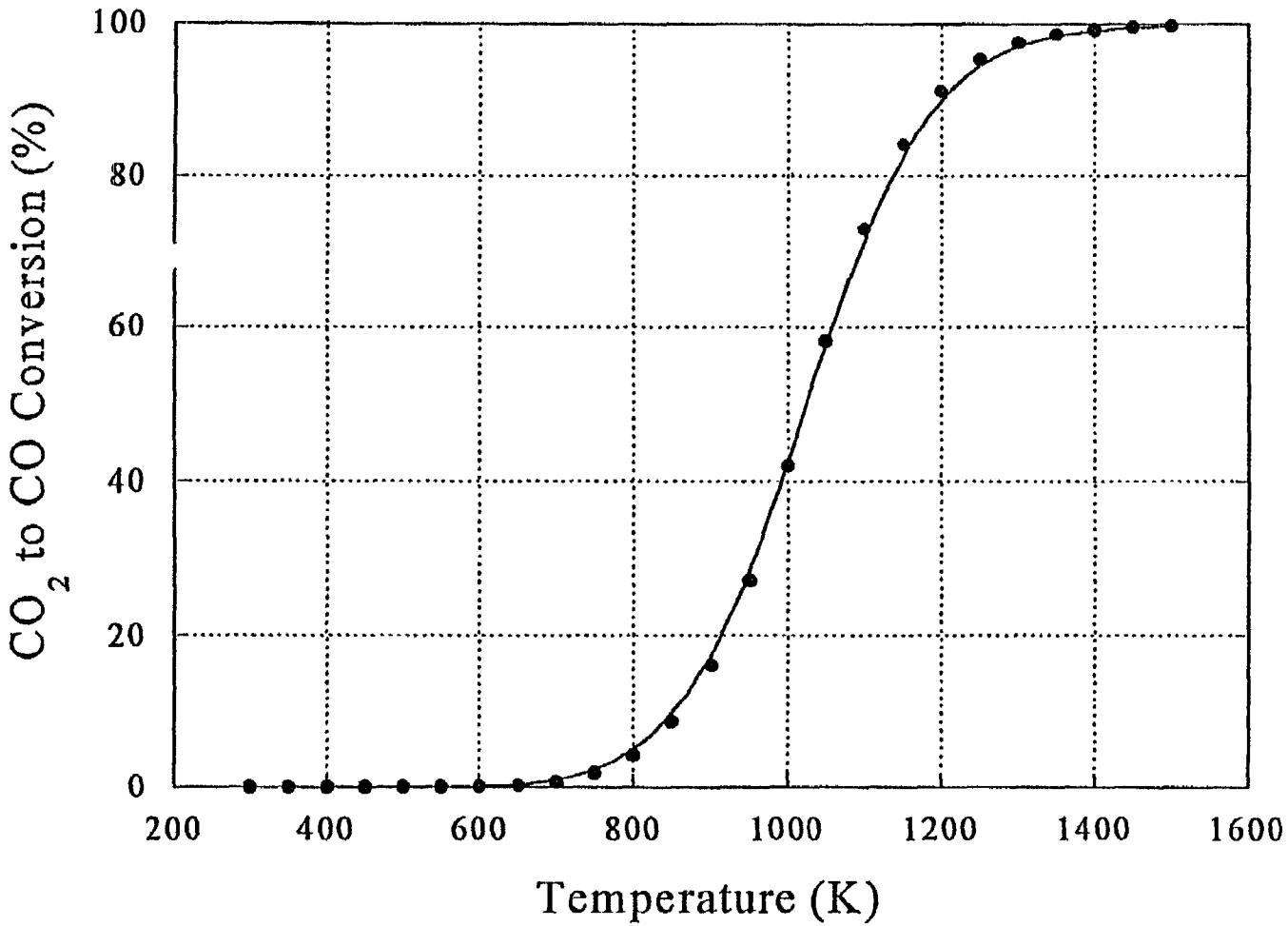
FIG. 2 depicts the temperature dependence of the percentage conversion of carbon dioxide to carbon monoxide by carbon to form carbon monoxide.

In selecting a nanoparticle additive, various thermodynamic considerations may be taken into account, to ensure that oxidation and/or catalysis will occur efficiently, as will be apparent to the skilled artisan. For example, FIG. 1 shows a thermodynamic analysis of the Gibbs Free Energy and Enthalpy temperature dependence for the oxidation of carbon monoxide to carbon dioxide. FIG. 2 shows the temperature dependence of the percentage of carbon dioxide conversion with carbon to form carbon monoxide.

In a preferred embodiment, metal oxide nanoparticles are used. Any suitable metal oxide in the form of nanoparticles may be used. Optionally, one or more metal oxides may also be used as mixtures or in combination, where the metal oxides may be different chemical entities or different forms of the same metal oxide.

Preferred nanoparticle additives include metal oxides, such as $Fe_2O_3$, CuO, $TiO_2$, $CeO_2$, $Ce_2O_3$, or $Al_2O_3$, or doped metal oxides such as $Y_2O_3$ doped with zirconium, $Mn_2O_3$ doped with palladium. Mixtures of additives may also be used. In particular, $Fe_2O_3$ is preferred because it is not known to produce any unwanted byproducts, and will simply be reduced to FeO or Fe after the reaction. Further, when $Fe_2O_3$ is used as the additive, it will not be converted to an environmentally hazardous material. Moreover, use of a precious metal can be avoided, as the $Fe_2O_3$ nanoparticles are economical and readily available. In particular, NANOCAT® Superfine Iron Oxide (SFIO) and NANOCAT® Magnetic Iron Oxide, described above, are preferred additives.

Figure 3:
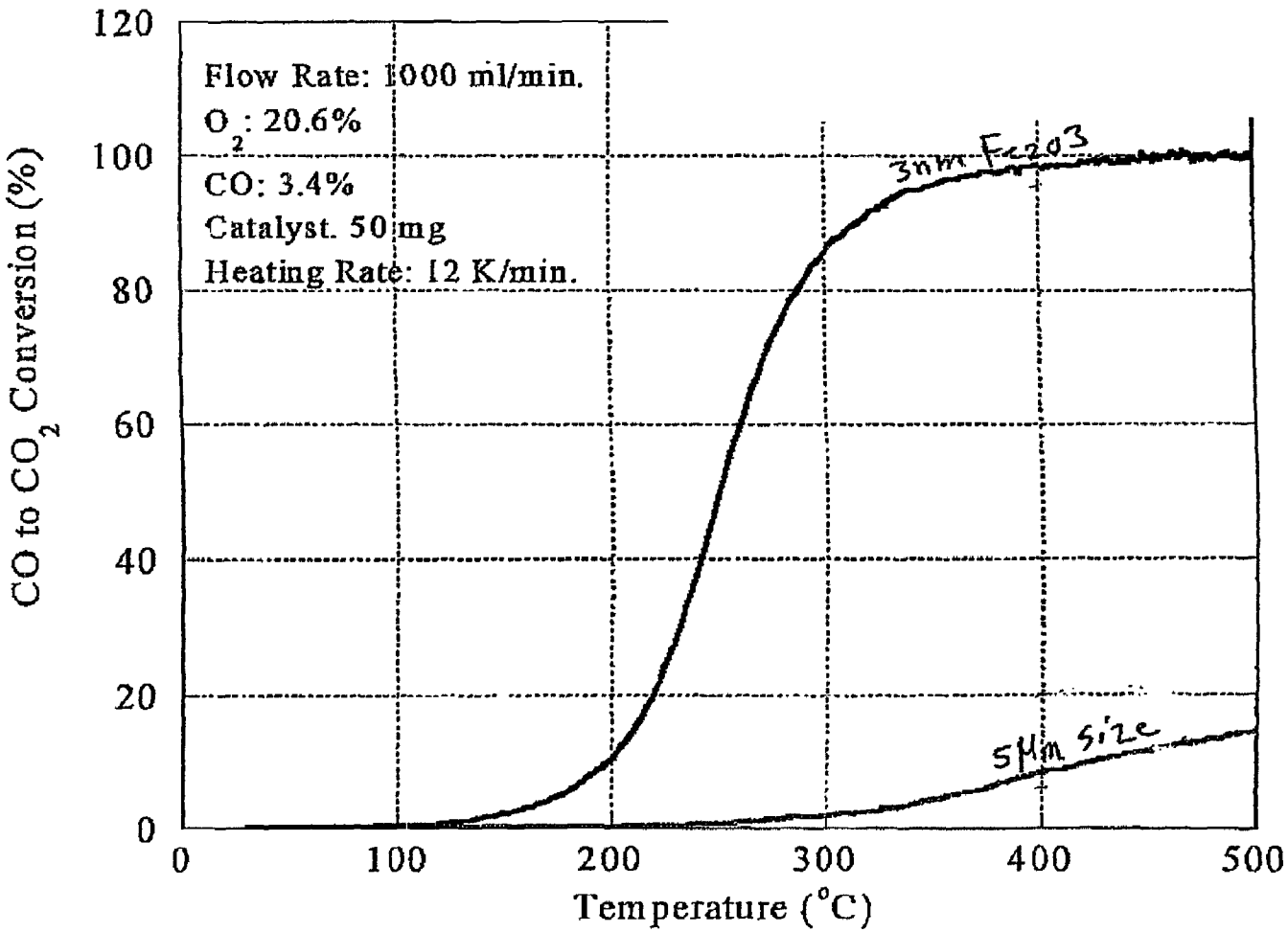
FIG. 3 depicts a comparison between the catalytic activity of $Fe_2O_3$ nanoparticles (NANOCAT® Superfine Iron Oxide (SFIO) from MACH I, Inc., King of Prussia, Pa.) having an average particle size of about 3 nm, versus $Fe_2O_3$ powder (from Aldrich Chemical Company) having an average particle size of about 5 $\mu$m.

FIG. 3 shows a comparison between the catalytic activity of $Fe_2O_3$ nanoparticles (NANOCAT® Superfine Iron Oxide (SFIO) from MACH I, Inc., King of Prussia, Pa.) having an average particle size of about 3 nm, versus $Fe_2O_3$ powder (from Aldrich Chemical Company) having an average particle size of about 5 $\mu$m. The $Fe_2O_3$ nanoparticles show a much higher percentage of conversion of carbon monoxide to carbon dioxide than the $Fe_2O_3$ having an average particle size of about 5 $\mu$m.

Figure 4A:
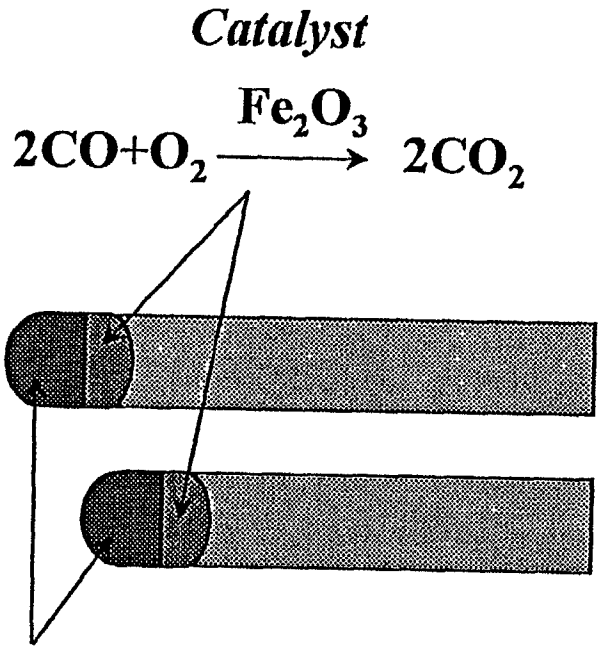
FIGS. 4A and 4B depict the pyrolysis region (where the $Fe_2O_3$ nanoparticles act as a catalyst) and the combustion zone (where the $Fe_2O_3$ nanoparticles act as an oxidant) in a cigarette.
Figure 4B:
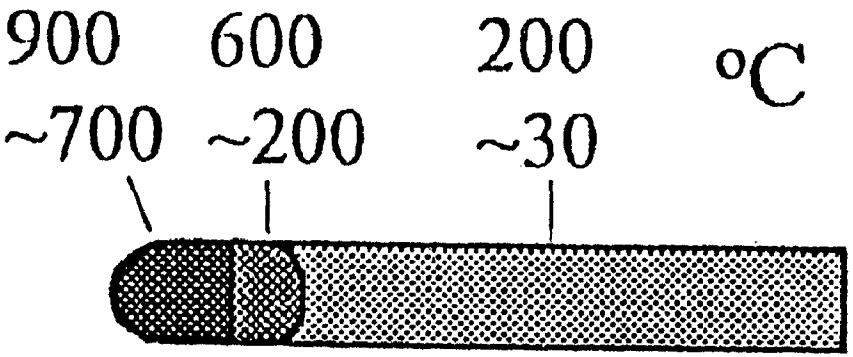

$Fe_2O_3$ nanoparticles are capable of acting as both an oxidant for the conversion of carbon monoxide to carbon dioxide and as a catalyst for the conversion of carbon monoxide to carbon dioxide. As shown schematically in FIG. 4A, the $Fe_2O_3$ nanoparticles act as a catalyst in the pyrolysis zone, and act as an oxidant in the combustion region. FIG. 4B shows various temperature zones in a lit cigarette. The oxidant/catalyst dual function and the reaction temperature range make $Fe_2O_3$ nanoparticles a useful additive in cigarettes and tobacco mixtures for the reduction of carbon monoxide during smoking. Also, during the smoking of the cigarette, the $Fe_2O_3$ nanoparticles may be used initially as a catalyst (i.e. in the pyrolysis zone), and then as an oxidant (i.e. in the combustion region).

Various experiments to further study thermodynamic and kinetics of various catalysts were conducted using a quartz flow tube reactor. The kinetics equation governing these reactions is as follows:

$$ln(1-x)=-A_o e^{-(Ea/RT)}\bullet(s\bullet 1/F)$$

where the variables are defined as follows:

x=the percentage of carbon monoxide converted to carbon dioxide $A_o$=the pre-exponential factor, $5\times10^{-6}$ $s^{-1}$ R=the gas constant, $1.987\times10^{-3}$ kcal/(mol•K)

Figure 5:
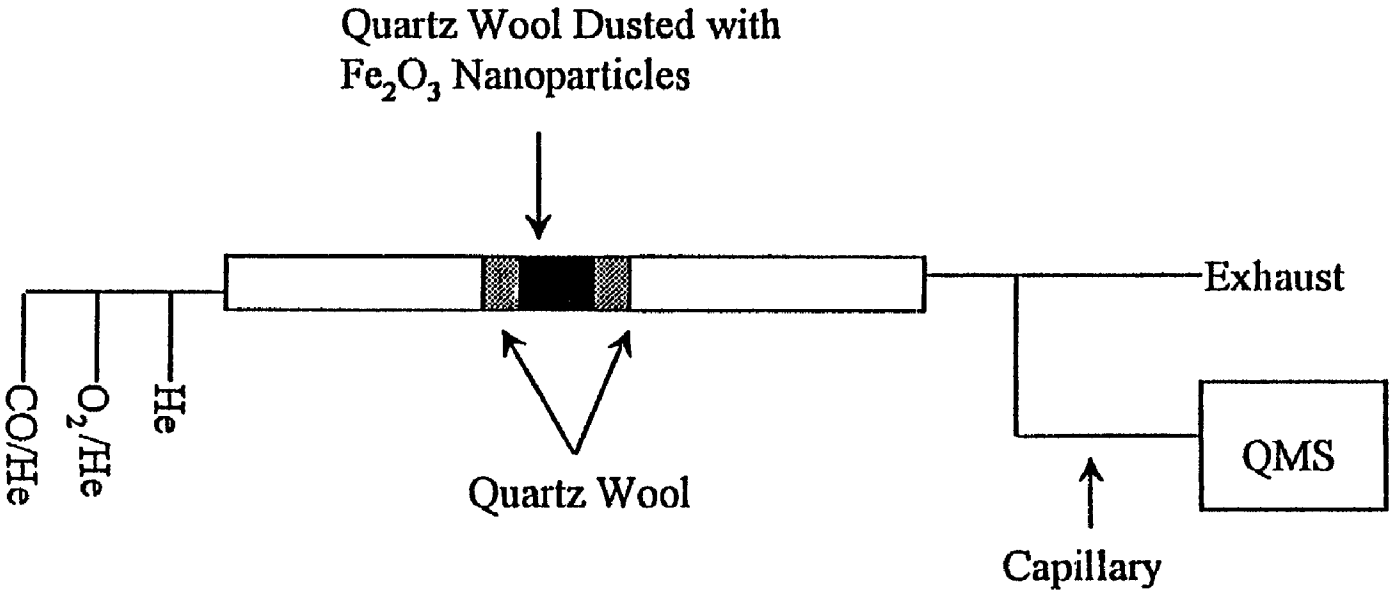
FIG. 5 depicts a schematic of a quartz flow tube reactor.

$E_a$=activation energy, 14.5 kcal/mol s=cross section of the flow tube, 0.622 $cm^2$ l=length of the catalyst, 1.5 cm F=flow rate, in $cm^3/s$ A schematic of a quartz flow tube reactor, suitable for carrying out such studies, is shown in FIG. 5. Helium, oxygen/helium and/or carbon monoxide/helium mixtures may be introduced at one end of the reactor. A quartz wool dusted with $Fe_2O_3$ nanoparticles is placed within the reactor. The products exit the reactor at a second end, which comprises an exhaust and a capillary line to a Quadrupole Mass Spectrometer ("QMS"). The relative amounts of products can thus be determined for a variety of reaction conditions.

Figure 6:
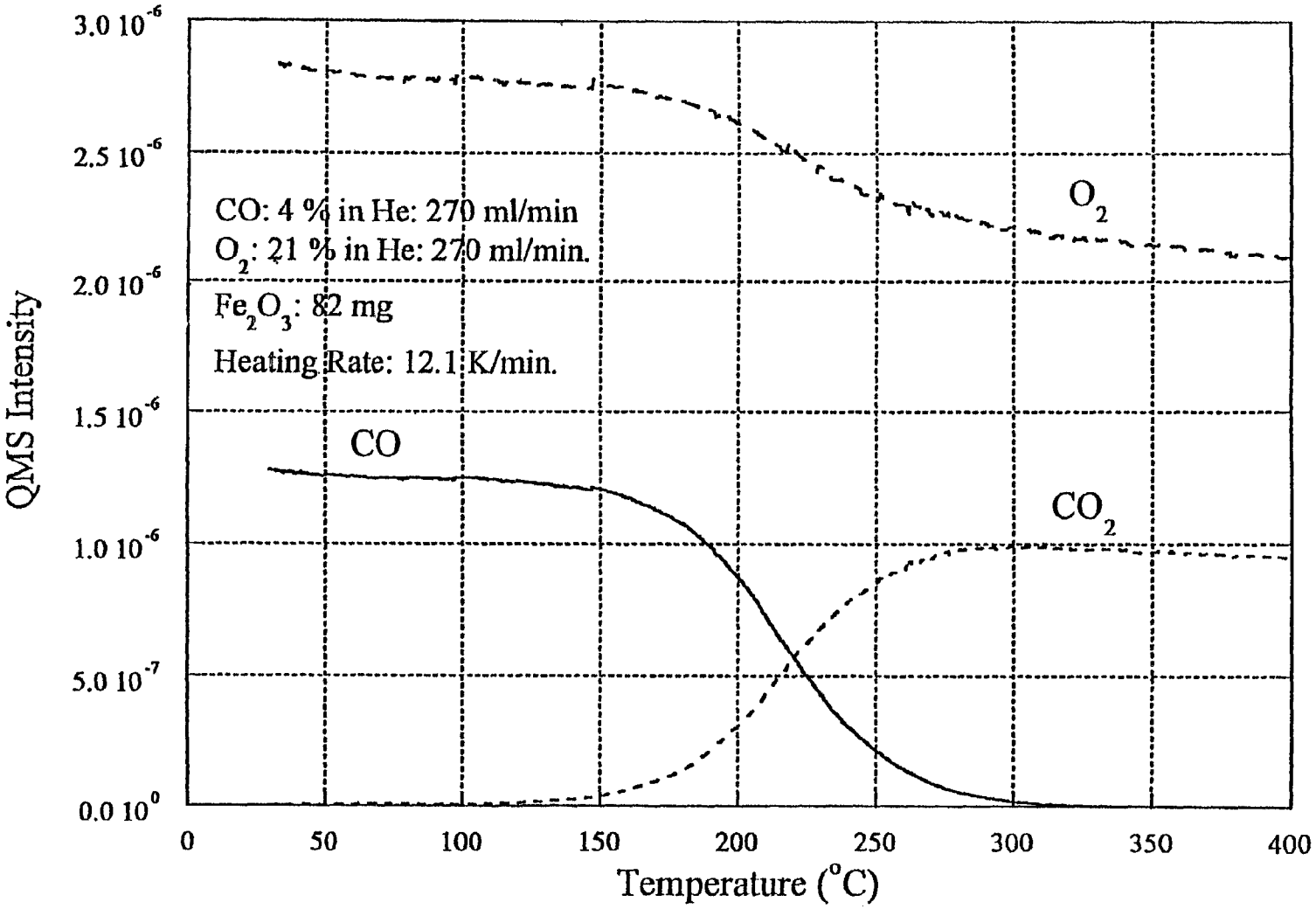
FIG. 6 illustrates the temperature dependence on the production of carbon monoxide, carbon dioxide and oxygen, when using $Fe_2O_3$ nanoparticles as the catalyst for the oxidation of carbon monoxide with oxygen to produce carbon dioxide.

FIG. 6 is a graph of temperature versus QMS intensity for a test wherein $Fe_2O_3$ nanoparticles are used as a catalyst for the reaction of carbon monoxide with oxygen to produce carbon dioxide. In the test, about 82 mg of $Fe_2O_3$ nanoparticles are loaded in the quartz flow tube reactor. Carbon monoxide is provided at 4% concentration in helium at a flow rate of about 270 mL/min, and oxygen is provided at 21% concentration in helium at a flow rate of about 270 mL/min. The heating rate is about 12.1 K/min. As shown in this graph, $Fe_2O_3$ nanoparticles are effective at converting carbon monoxide to carbon dioxide at temperatures above around 225° C.

Figure 7:
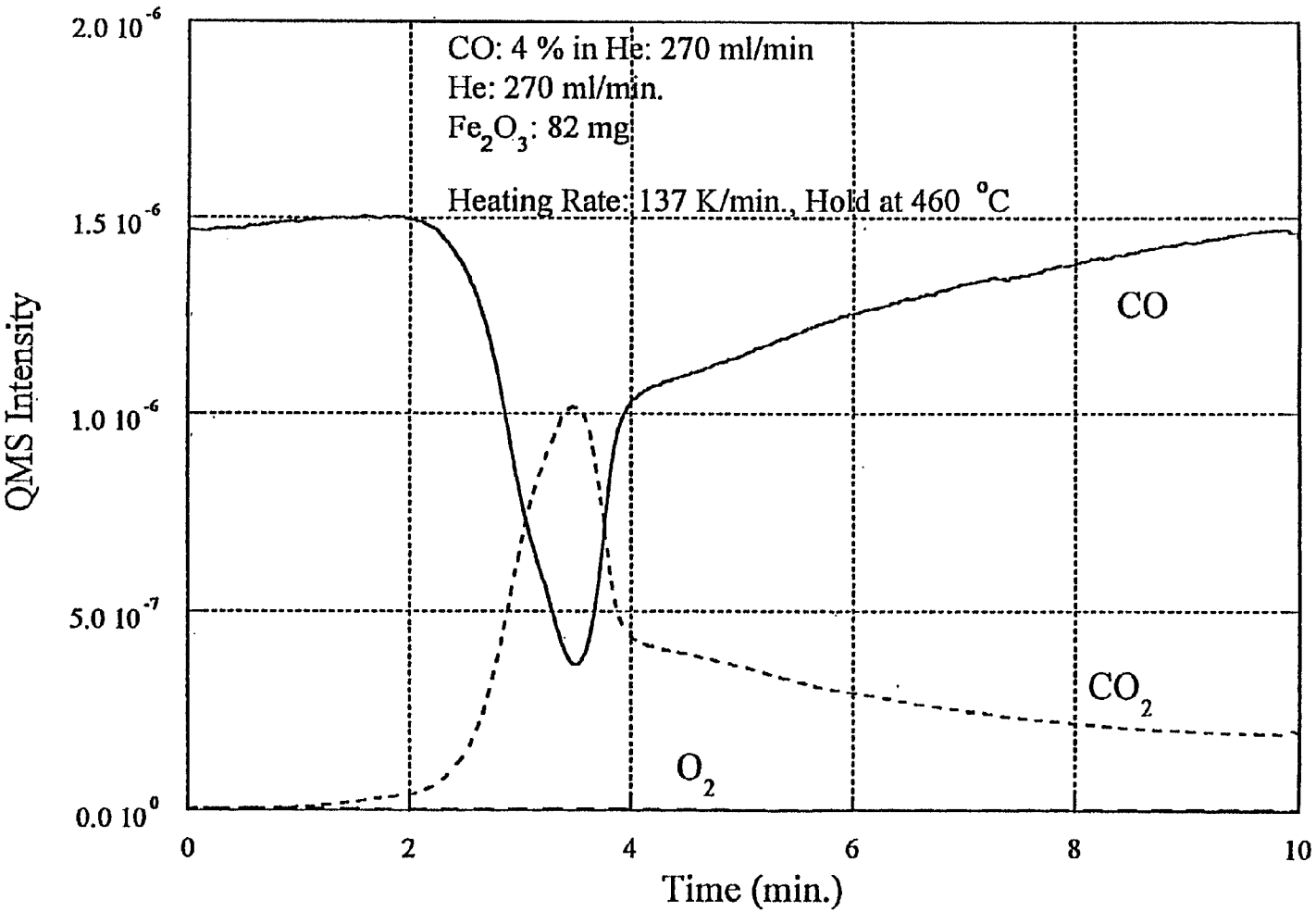
FIG. 7 illustrates the relative production of carbon monoxide, carbon dioxide and oxygen, when using $Fe_2O_3$ nanoparticles as an oxidant for the reaction of $Fe_2O_3$ with carbon monoxide to produce carbon dioxide and FeO.

FIG. 7 is a graph of time versus QMS intensity for a test wherein $Fe_2O_3$ nanoparticles are studied as an oxidant for the reaction of $Fe_2O_3$ with carbon monoxide to produce carbon dioxide and FeO. In the test, about 82 mg of $Fe_2O_3$ nanoparticles are loaded in the quartz flow tube reactor. Carbon monoxide is provided at 4% concentration in helium at a flow rate of about 270 mL/min, and the heating rate is about 137 mL/min to a maximum temperature of 460° C. As suggested by data shown in FIGS. 6 and 7, $Fe_2O_3$ nanoparticles are effective in conversion of carbon monoxide to carbon dioxide under conditions similar to those during smoking of a cigarette.

Figure 8A:
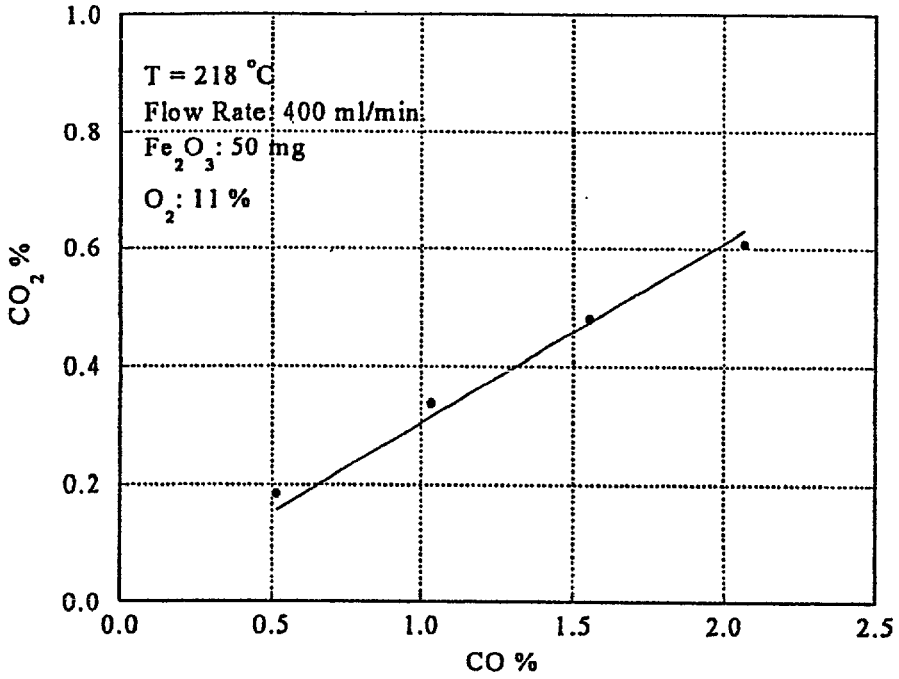
FIGS. 8A and 8B illustrate the reaction orders of carbon monoxide and carbon dioxide with $Fe_2O_3$ as a catalyst.
Figure 8B:
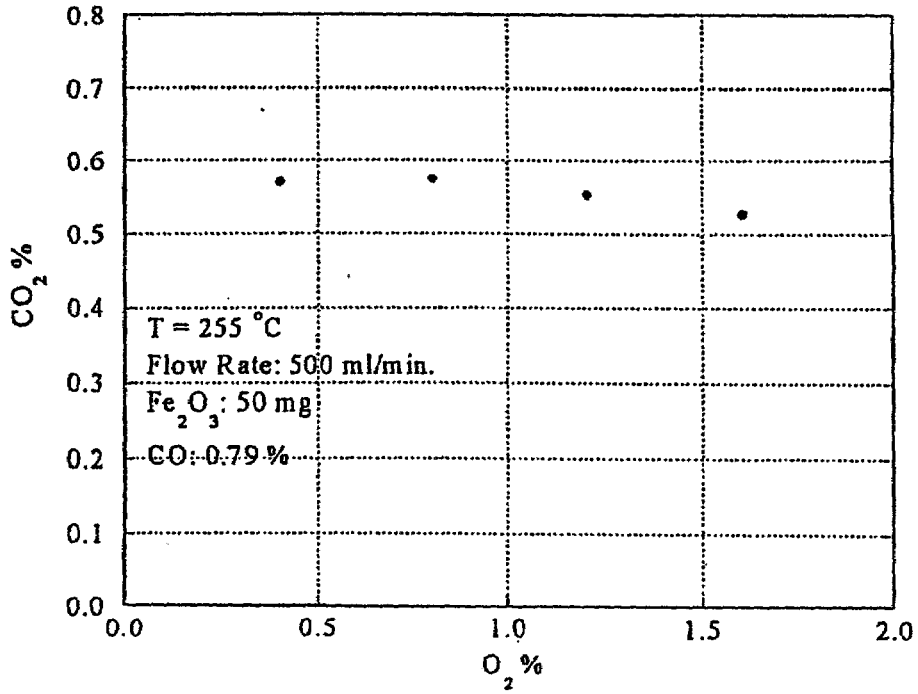
Figure 9:
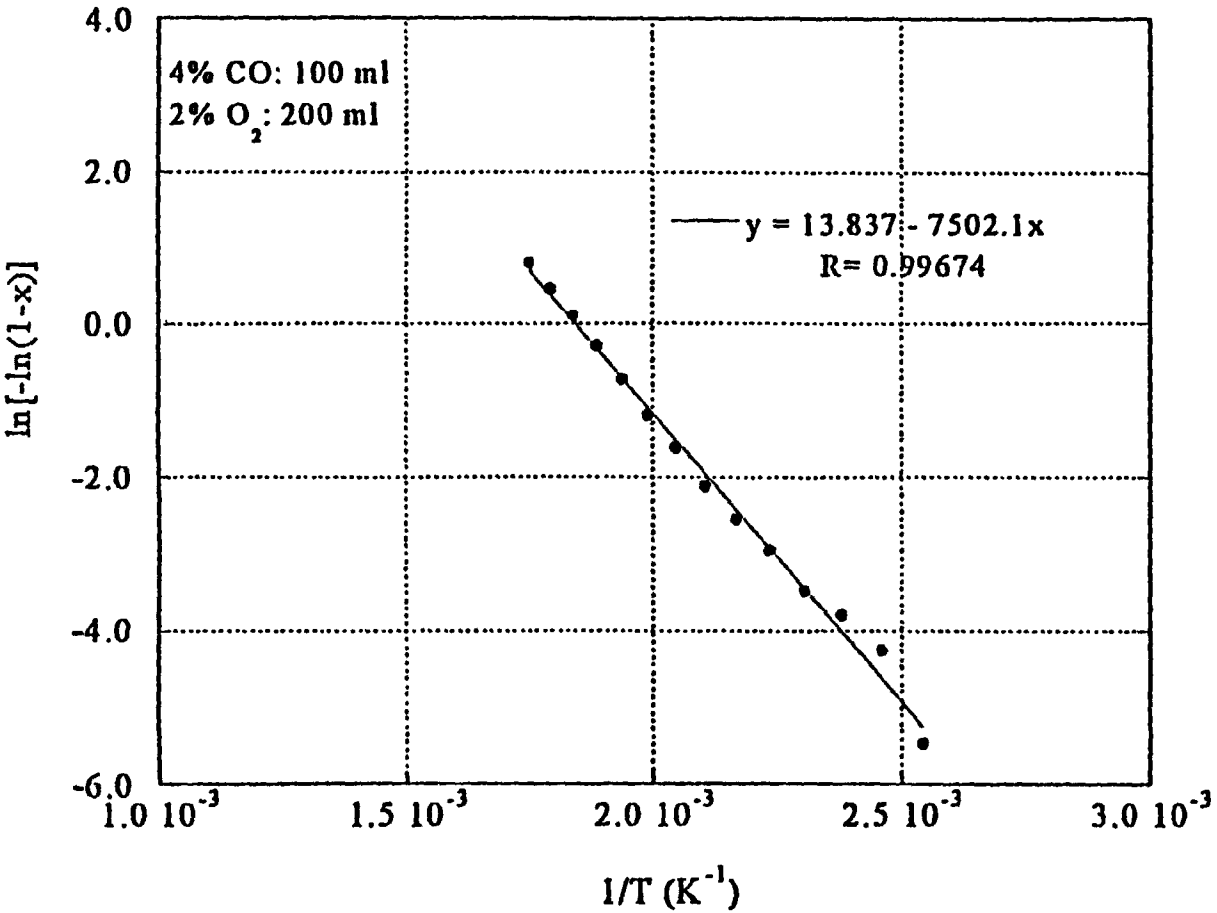
FIG. 9 depicts the measurement of the activation energy and the pre-exponential factor for the reaction of carbon monoxide with oxygen to produce carbon dioxide, using $Fe_2O_3$ nanoparticles as a catalyst for the reaction.

FIGS. 8A and 8B are graphs showing the reaction orders of carbon monoxide and carbon dioxide with $Fe_2O_3$ as a catalyst. FIG. 9 depicts the measurement of the activation energy and the pre-exponential factor for the reaction of carbon monoxide with oxygen to produce carbon dioxide, using $Fe_2O_3$ nanoparticles as a catalyst for the reaction. A summary of activation energies is provided in Table 1.

TABLE 1

Summary of the Activation Energies and Pre-exponential Factors

| | Flow Rate (mL/min) | CO % | $O_2$ % | $A_0$ ($s^{-1}$) | $E_a$ (kcal/mol) |
|---|---|---|---|---|---|
| 1 | 300 | 1.32 | 1.34 | $1.8\times10^7$ | 14.9 |
| 2 | 900 | 1.32 | 1.34 | $8.2\times10^6$ | 14.7 |
| 3 | 1000 | 3.43 | 20.6 | $2.3\times10^6$ | 13.5 |
| 4 | 500 | 3.43 | 20.6 | $6.6\times10^6$ | 14.3 |
| 5 | 250 | 3.42 | 20.6 | $2.2\times10^7$ | 15.3 |
| AVG. | | | | $5\times10^6$ | 14.5 |
| Ref. | | | | | |
| 1 | Gas Phase | | | | 39.7 |
| 2 | 2% $Au/TiO_2$ | | | | 7.6 |
| 3 | 2.2% $Pd/Al_2O_3$ | | | | 9.6 |

Figure 10:
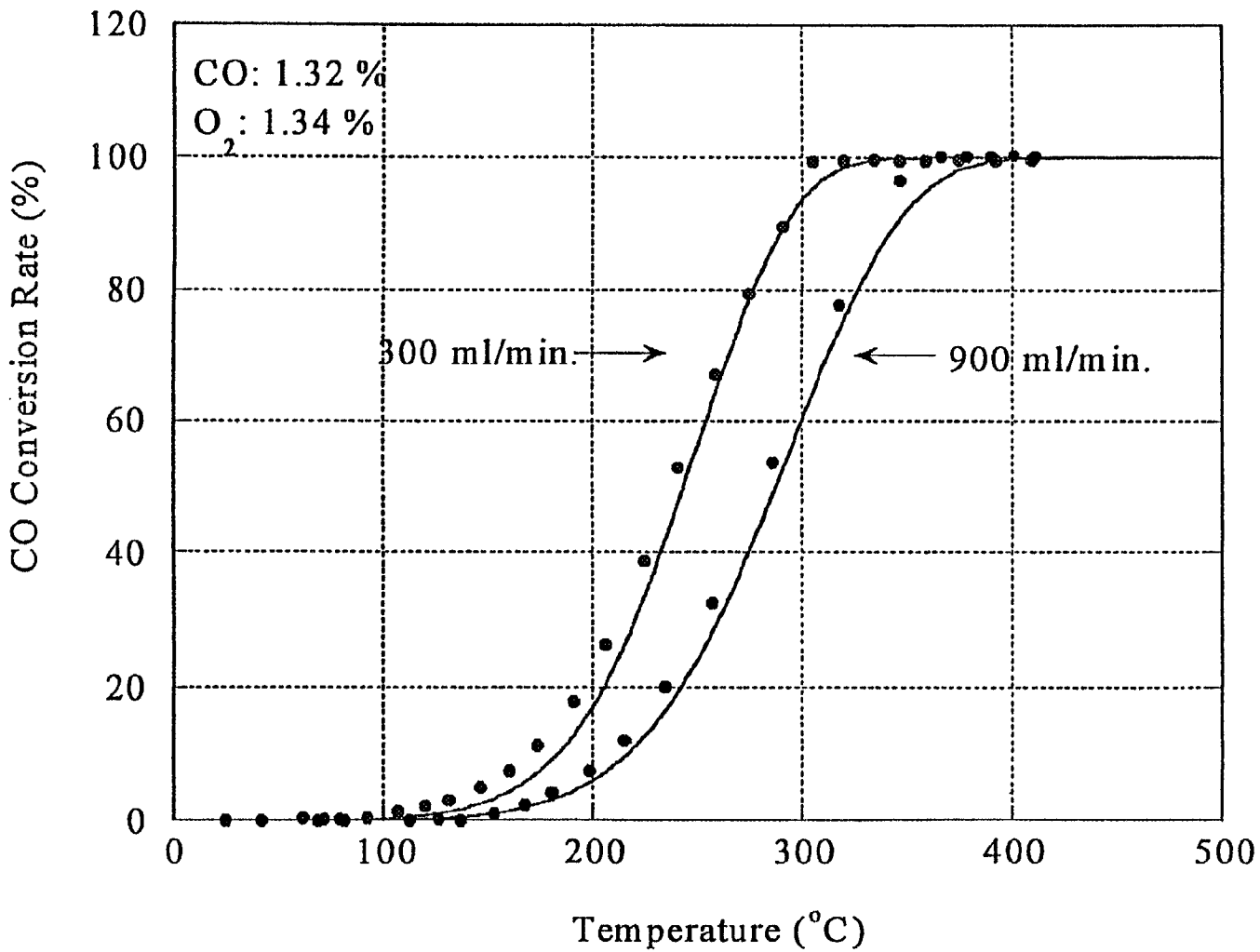
FIG. 10 depicts the temperature dependence for the conversion rate of carbon monoxide, for flow rates of 300 mL/min and 900 mL/min respectively.

FIG. 10 depicts the temperature dependence for the conversion rate of carbon monoxide using 50 mg $Fe_2O_3$ nanoparticles as catalyst in the quartz tube reactor, for flow rates of 300 mL/min and 900 mL/min respectively.

Figure 11:
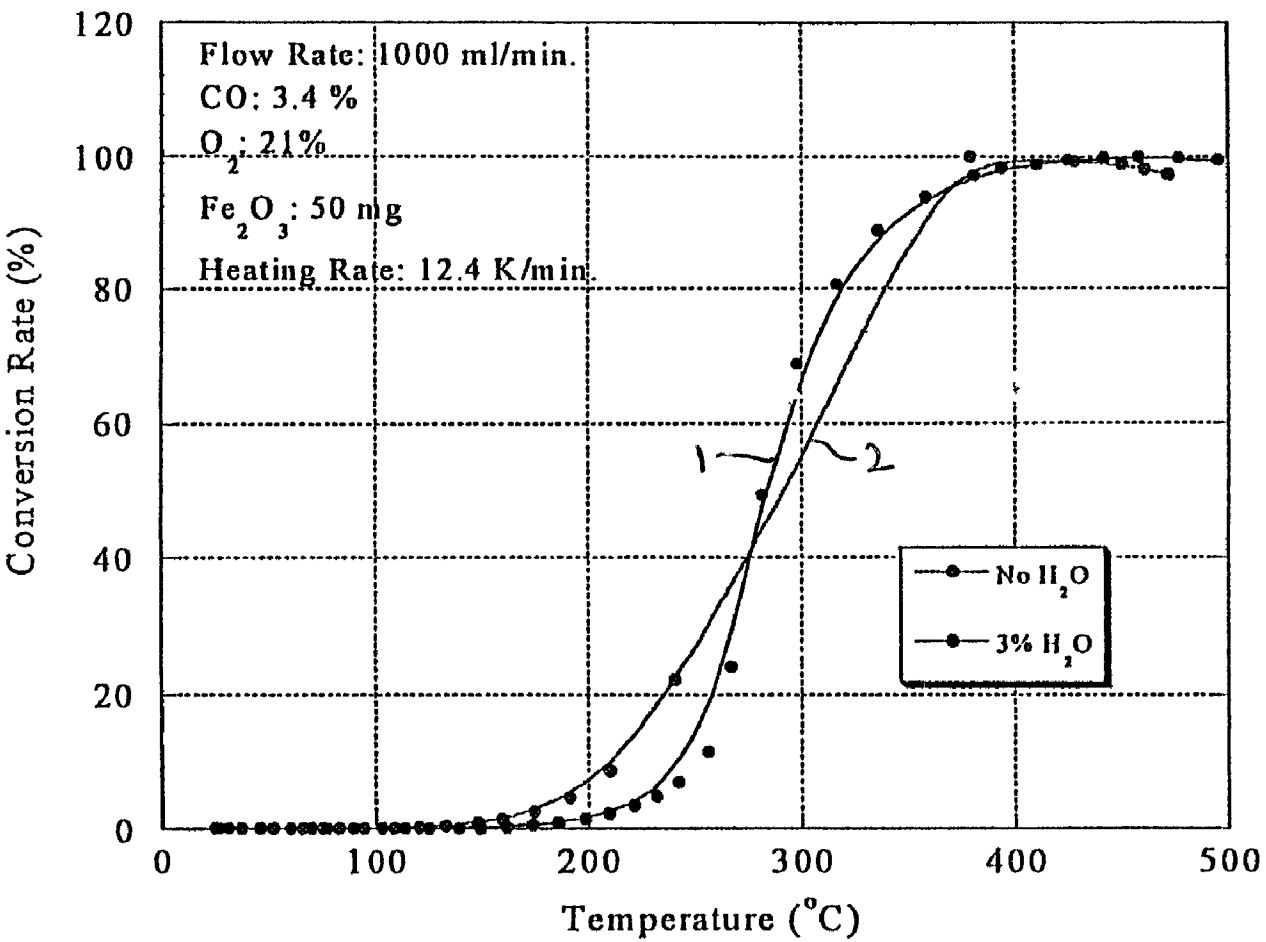
FIG. 11 depicts contamination and deactivation studies for water wherein curve 1 represents the condition for 3% $H_2O$ and curve 2 represents the condition for no $H_2O$.

FIG. 11 depicts contamination and deactivation studies for water using 50 mg $Fe_2O_3$ nanoparticles as catalyst in the quartz tube reactor. As can be seen from the graph, compared to curve 1 (without water), the presence of up to 3% water (curve 2) has little effect on the ability of $Fe_2O_3$ nanoparticles to convert carbon monoxide to carbon dioxide.

Figure 12:
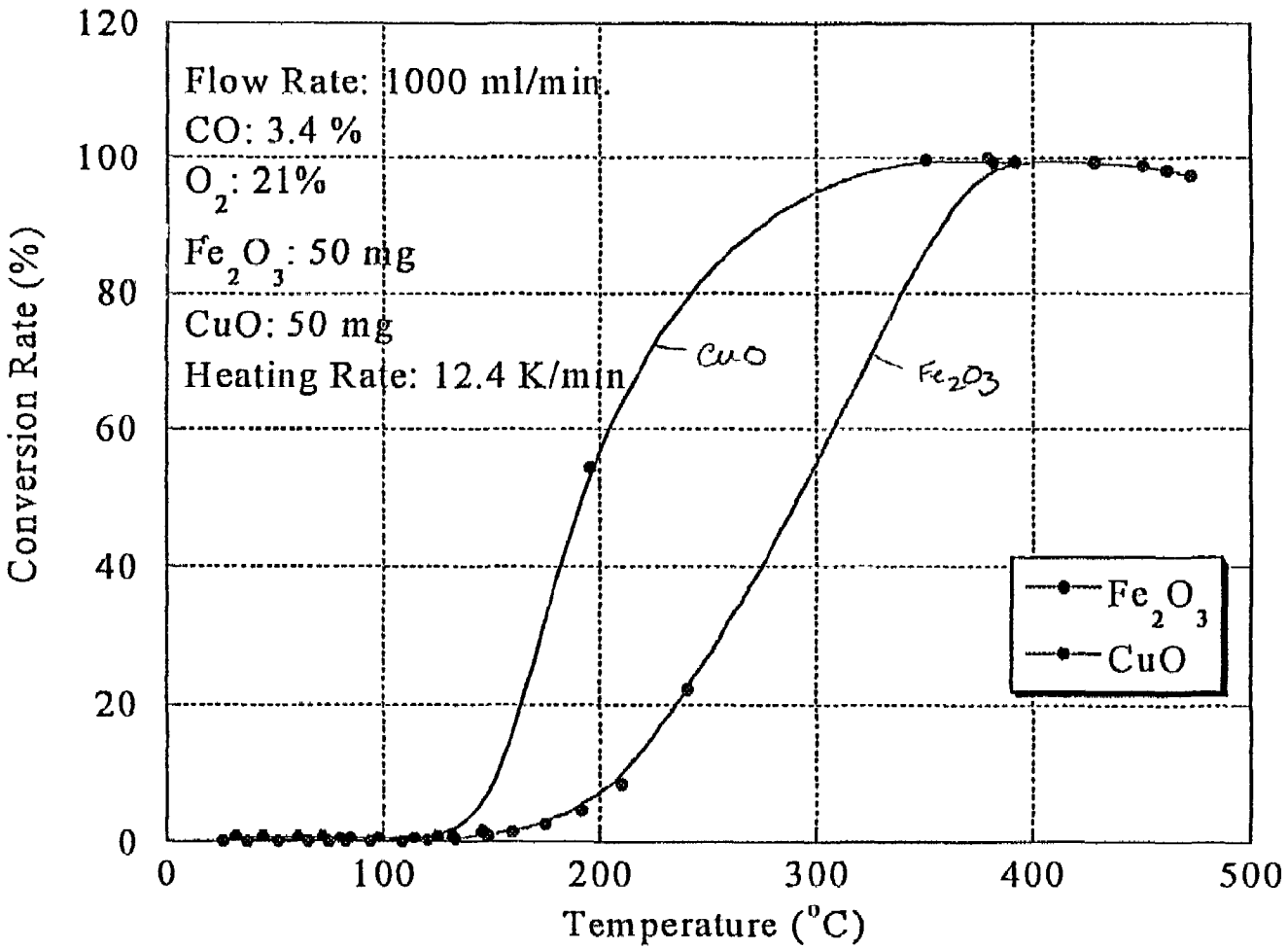
FIG. 12 depicts the temperature dependence for the conversion rates of CuO and $Fe_2O_3$ nanoparticles as catalysts for the oxidation of carbon monoxide with oxygen to produce carbon dioxide.

FIG. 12 illustrates a comparison between the temperature dependence of conversion rate for CuO and $Fe_2O_3$ nanoparticles using 50 mg $Fe_2O_3$ and 50 mg CuO nanoparticles as catalyst in the quartz tube reactor. Although the CuO nanoparticles have higher conversion rates at lower temperatures, at higher temperatures, the CuO and $Fe_2O_3$ have the same conversion rates.

Figure 13:
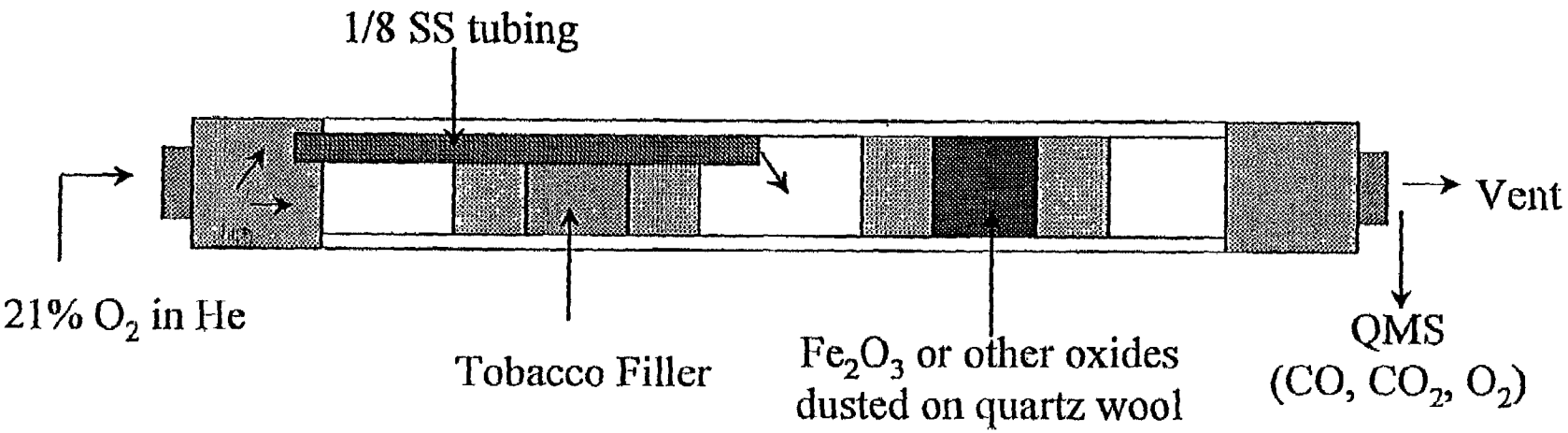
FIG. 13 depicts a flow tube reactor to simulate a cigarette in evaluating different nanoparticle catalysts.

FIG. 13 shows a flow tube reactor to simulate a cigarette in evaluating different nanopaticle catalysts. Table 2 shows a comparison between the ratio of carbon monoxide to carbon dioxide, and the percentage of oxygen depletion when using CuO, $Al_2O_3$, and $Fe_2O_3$ nanoparticles.

TABLE 2

Comparison between CuO, $Al_2O_3$, and $Fe_2O_3$ nanoparticles

| Nanoparticle | $CO/CO_2$ | $O_2$ Depletion (%) |
|---|---|---|
| None | 0.51 | 48 |
| $Al_2O_3$ | 0.40 | 60 |
| CuO | 0.29 | 67 |
| $Fe_2O_3$ | 0.23 | 100 |

In the absence of nanoparticles, the ratio of carbon monoxide to carbon dioxide is about 0.51 and the oxygen depletion is about 48%. The data in Table 2 illustrates the improvement obtained by using nanoparticles. The ratio of carbon monoxide to carbon dioxide drops to 0.40, 0.29, and 0.23 for $Al_2O_3$, CuO and $Fe_2O_3$ nanoparticles, respectively. The oxygen depletion increases to 60%, 67% and 100% for $Al_2O_3$, CuO and $Fe_2O_3$ nanoparticles, respectively.

Figure 14:
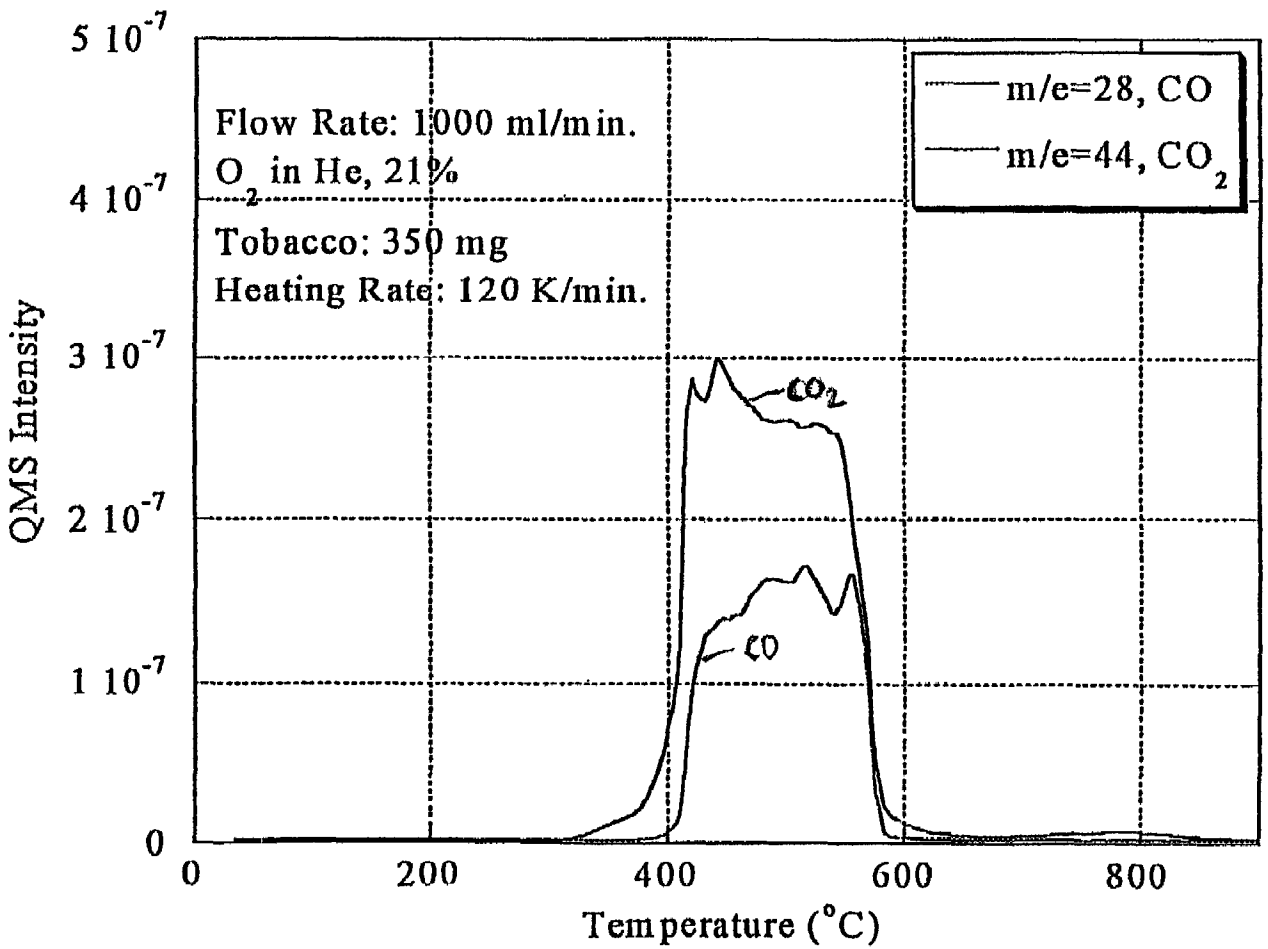
FIG. 14 depicts the relative amounts of carbon monoxide and carbon dioxide production without a catalyst present.
Figure 15:
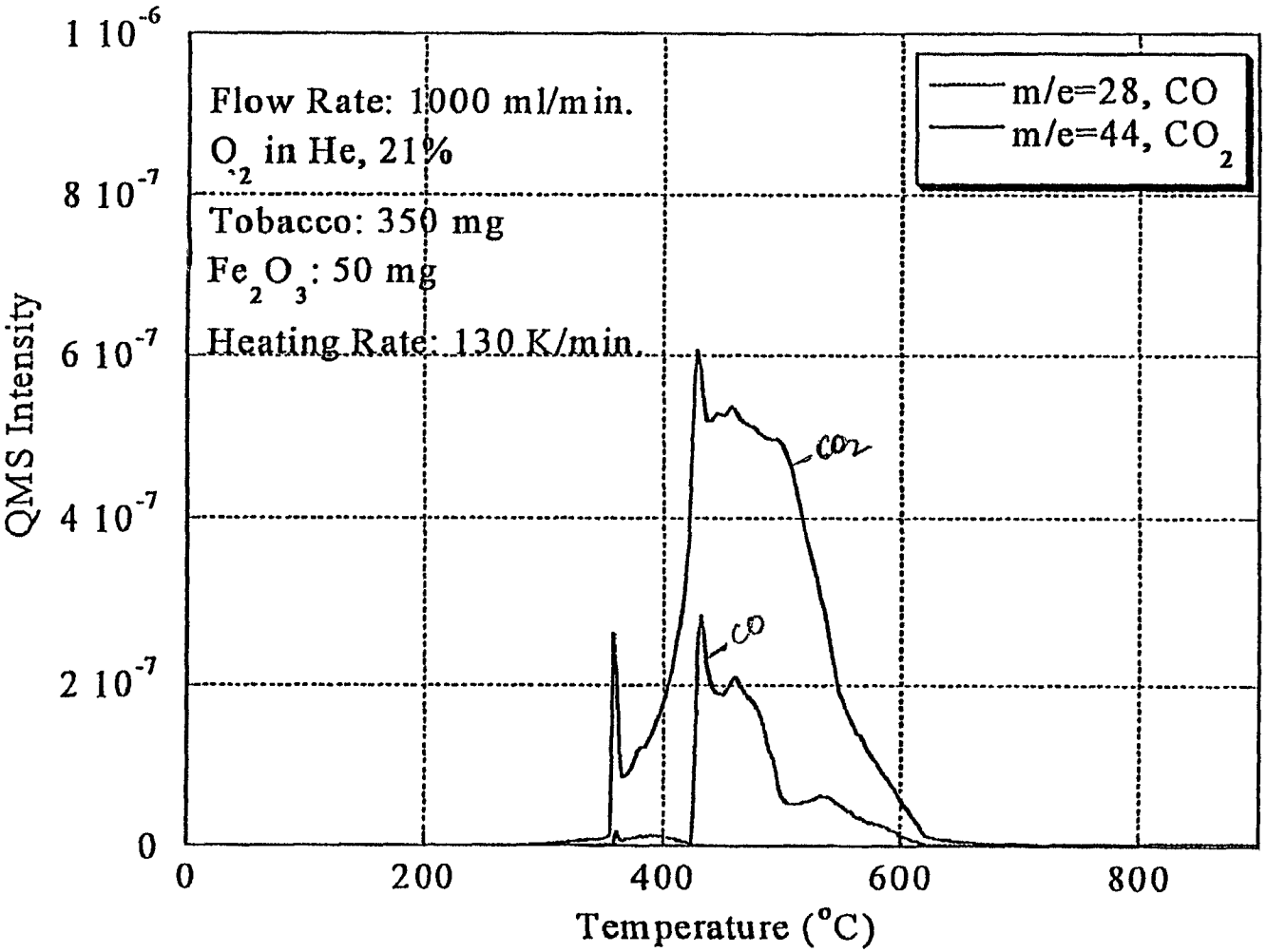
FIG. 15 depicts the relative amounts of carbon monoxide and carbon dioxide production with a catalyst present.

FIG. 14 is a graph of temperature versus QMS intensity in a test which shows the amounts of carbon monoxide and carbon dioxide production without a catalyst present. FIG. 15 is a graph of temperature versus QMS intensity in a test which shows the amounts of carbon monoxide and carbon dioxide production when using $Fe_2O_3$ nanoparticles as a catalyst. As can be seen by comparing FIG. 14 and FIG. 15, the presence of $Fe_2O_3$ nanoparticles increases the ratio of carbon dioxide to carbon monoxide present, and decreases the amount of carbon monoxide present.

The nanoparticle additives, as described above, may be provided along the length of a tobacco rod by distributing the additive nanoparticles on the tobacco or incorporating them into the cut filler tobacco using any suitable method. The nanoparticles may be provided in the form of a powder or in a solution in the form of a dispersion. In a preferred method, nanoparticle additives in the form of a dry powder are dusted on the cut filler tobacco. The nanoparticle additives may also be present in the form of a solution and sprayed on the cut filler tobacco. Alternatively, the tobacco may be coated with a solution containing the nanoparticle additives. The nanoparticle additive may also be added to the cut filler tobacco stock supplied to the cigarette making machine or added to a tobacco rod prior to wrapping cigarette paper around the cigarette rod.

The nanoparticle additives will preferably be distributed throughout the tobacco rod portion of a cigarette and optionally the cigarette filter. By providing the nanoparticle additives throughout the entire tobacco rod, it is possible to reduce the amount of carbon monoxide throughout the cigarette, and particularly at both the combustion region and in the pyrolysis zone.

The amount of the nanoparticle additive should be selected such that the amount of carbon monoxide in mainstream smoke is reduced during smoking of a cigarette. Preferably, the amount of the nanoparticle additive will be from about a few milligrams, for example, 5 mg/cigarette, to about 100 mg/cigarette. More preferably, the amount of nanoparticle additive will be from about 40 mg/cigarette to about 50 mg/cigarette.

One embodiment of the invention relates to a cut filler composition comprising tobacco and at least one additive, as described above, which is capable of acting as an oxidant for the conversion of carbon monoxide to carbon dioxide and/or as a catalyst for the conversion of carbon monoxide to carbon dioxide, where the additive is in the form of nanoparticles.

Any suitable tobacco mixture may be used for the cut filler. Examples of suitable types of tobacco materials include flue-cured, Burley, Maryland or Oriental tobaccos, the rare or specialty tobaccos, and blends thereof. The tobacco material can be provided in the form of tobacco lamina; processed tobacco materials such as volume expanded or puffed tobacco, processed tobacco stems such as cut-rolled or cut-puffed stems, reconstituted tobacco materials; or blends thereof. The invention may also be practiced with tobacco substitutes.

In cigarette manufacture, the tobacco is normally employed in the form of cut filler, i.e. in the form of shreds or strands cut into widths ranging from about 1/10 inch to about 1/20 inch or even 1/40 inch. The lengths of the strands range from between about 0.25 inches to about 3.0 inches. The cigarettes may further comprise one or more flavorants or other additives (e.g. burn additives, combustion modifying agents, coloring agents, binders, etc.) known in the art.

Another embodiment of the invention relates to a cigarette comprising a tobacco rod, wherein the tobacco rod comprises cut filler having at least one additive, as described above, which is capable of acting as an oxidant for the conversion of carbon monoxide to carbon dioxide and/or as a catalyst for the conversion of carbon monoxide to carbon dioxide, wherein the additive is in the form of nanoparticles. A further embodiment of the invention relates to a method of making a cigarette, comprising (i) adding an additive to a cut filler, wherein the additive, as described above, which is capable of acting as an oxidant for the conversion of carbon monoxide to carbon dioxide and/or as a catalyst for the conversion of carbon monoxide to carbon dioxide, wherein the additive is in the form of nanoparticles; (ii) providing the cut filler comprising the additive to a cigarette making machine to form a tobacco rod; and (iii) placing a paper wrapper around the tobacco rod to form the cigarette.

Techniques for cigarette manufacture are known in the art. Any conventional or modified cigarette making technique may be used to incorporate the nanoparticle additives. The resulting cigarettes can be manufactured to any known specifications using standard or modified cigarette making techniques and equipment. Typically, the cut filler composition of the invention is optionally combined with other cigarette additives, and provided to a cigarette making machine to produce a tobacco rod, which is then wrapped in cigarette paper, and optionally tipped with filters.

The cigarettes of the invention may range from about 50 mm to about 120 mm in length. Generally, a regular cigarette is about 70 mm long, a "King Size" is about 85 mm long, a "Super King Size" is about 100 mm long, and a "Long" is usually about 120 mm in length. The circumference is from about 15 mm to about 30 mm in circumference, and preferably around 25 mm. The packing density is typically between the range of about 100 $mg/cm^3$ to about 300 $mg/cm^3$, and preferably 150 $mg/cm^3$ to about 275 $mg/cm^3$.

Yet another embodiment of the invention relates to a method of smoking the cigarette described above, which involves lighting the cigarette to form smoke and inhaling the smoke, wherein during the smoking of the cigarette, the additive acts as an oxidant for the conversion of carbon monoxide to carbon dioxide and/or as a catalyst for the conversion of carbon monoxide to carbon dioxide.

"Smoking" of a cigarette means the heating or combustion of the cigarette to form smoke, which can be inhaled. Generally, smoking of a cigarette involves lighting one end of the cigarette and inhaling the cigarette smoke through the mouth end of the cigarette, while the tobacco contained therein undergoes a combustion reaction. However, the cigarette may also be smoked by other means. For example, the cigarette may be smoked by heating the cigarette and/or heating using electrical heater means, as described in commonly-assigned U.S. Pat. Nos. 6,053,176; 5,934,289; 5,934,289, 5,591,368 or 5,322,075, for example.

While the invention has been described with reference to preferred embodiments, it is to be understood that variations and modifications may be resorted to as will be apparent to those skilled in the art. Such variations and modifications are to be considered within the purview and scope of the invention as defined by the claims appended hereto.

All of the above-mentioned references are herein incorporated by reference in their entirety to the same extent as if each individual reference was specifically and individually indicated to be incorporated herein by reference in its entirety.

What is claimed is:

1. A cut filler composition comprising tobacco and an additive capable of acting as an oxidant for the conversion of carbon monoxide to carbon dioxide and/or as a catalyst for the conversion of carbon monoxide to carbon dioxide, wherein the additive consists essentially of iron oxide nanoparticles.

2. The cut filler composition of claim 1, wherein the additive is capable of acting as both an oxidant for the conversion of carbon monoxide to carbon dioxide and as a catalyst for the conversion of carbon monoxide to carbon dioxide.

3. The cut filler composition of claim 1, wherein the additive has an average particle size of less than about 500 nm.

4. The cut filler composition of claim 1, wherein the additive has an average particle size of less than about 50 nm.

5. The cut filler composition of claim 1, wherein the additive has a surface area from about 20 $m^2/g$ to about 200 $m^2/g$ or about 200 $m^2/g$ to about 400 $m^2/g$.

6. The cut filler composition of claim 1, wherein the additive is amorphous.

7. The cut filler composition of claim 1, wherein the additive is $Fe_2O_3$.

8. The cut filler composition of claim 1, wherein the additive oxidizes and/or catalyzes the conversion of carbon monoxide to carbon dioxide at a temperature greater than about 150° C.

9. The cut filler composition of claim 1, wherein the additive oxidizes and/or catalyzes the conversion of carbon monoxide to carbon dioxide at a temperature of from about 200° C. to 600° C.

10. A cigarette comprising a tobacco rod, wherein the tobacco rod comprises cut filler having an additive capable of acting as an oxidant for the conversion of carbon monoxide to carbon dioxide and/or as a catalyst for the conversion of carbon monoxide to carbon dioxide, wherein the additive consists essentially of iron oxide nanoparticles.

11. The cigarette of claim 10, wherein the additive is capable of acting as both an oxidant for the conversion of carbon monoxide to carbon dioxide and as a catalyst for the conversion of carbon monoxide to carbon dioxide.

12. The cigarette of claim 10, wherein the additive has an average particle size of less than about 500 nm.

13. The cigarette of claim 10, wherein the additive has an average particle size of less than about 50 nm.

14. The cigarette of claim 10, wherein the additive has a surface area from about 20 $m^2/g$ to about 200 $m^2/g$ or about 400 $m^2/g$ to about 300 $m^2/g$.

15. The cigarette of claim 10, wherein the cigarette comprises from about 5 mg to about 40 mg or about 40 mg to about 100 mg of the additive per cigarette.

16. The cigarette of claim 10, wherein the additive is amorphous.

17. The cigarette of claim 10, wherein the additive is $Fe_2O_3$.

18. The cigarette of claim 10, wherein the additive oxidizes and/or catalyzes the conversion of carbon monoxide to carbon dioxide at a temperature greater than about 150° C.

19. The cigarette of claim 10, wherein the additive oxidizes and/or catalyzes the conversion of carbon monoxide to carbon dioxide at a temperature of from about 200° C. to 600° C.

20. The cigarette of claim 10, wherein the additive has an average particle size of about 3 nm.

21. A method of making a cigarette, comprising (i) adding an additive to a cut filler, wherein the additive is capable of acting as an oxidant for the conversion of carbon monoxide to carbon dioxide and/or as a catalyst for the conversion of carbon monoxide to carbon dioxide, wherein the additive is in the form of iron oxide nanoparticles, and wherein the iron oxide nanoparticles have an average particle size of about 3 nm;

(ii) providing the cut filler comprising the additive to a cigarette making machine to form a tobacco rod; and (iii) placing a paper wrapper around the tobacco rod to form the cigarette.

22. The method of claim 21, wherein the additive is capable of acting as both an oxidant for the conversion of carbon monoxide to carbon dioxide and as a catalyst for the conversion of carbon monoxide to carbon dioxide.

23. The method of claim 21, wherein the additive further comprises CuO, $TiO_2$, $CeO_2$, $Ce_2O_3$, $Al_2O_3$, $Y_2O_3$ doped with zirconium, $Mn_2O_3$ doped with palladium, or mixtures thereof.

24. The method of claim 21, wherein the additive consists essentially of iron oxide nanoparticles.

25. The method of claim 21, wherein the cigarette comprises from about 5 mg to about 40 mg or about 40 mg to about 100 mg of the additive per cigarette.

26. The method of claim 21, wherein the additive is amorphous.

27. The method of claim 21, wherein the additive is $Fe_2O_3$.

28. The method of claim 21, wherein the additive oxidizes and/or catalyzes the conversion of carbon monoxide to carbon dioxide at a temperature greater than about 150° C.

29. The method of claim 21, wherein the additive oxidizes and/or catalyzes the conversion of carbon monoxide to carbon dioxide at a temperature of from about 200° C. to 600° C.

* * * * *